US006283343B1

(12) United States Patent
Hillmer

(10) Patent No.: US 6,283,343 B1
(45) Date of Patent: Sep. 4, 2001

(54) FOLDABLE BOOTJACK

(76) Inventor: Norval J. Hillmer, 2203 N. Florence Rd., Payson, AZ (US) 85541

( * ) Notice: Subject to any disclaimer, the term of this patent is extended or adjusted under 35 U.S.C. 154(b) by 0 days.

(21) Appl. No.: 09/767,120

(22) Filed: Jan. 22, 2001

(51) Int. Cl.[7] ..... A47G 25/86
(52) U.S. Cl. ..... 223/115; 223/114
(58) Field of Search ..... 223/114, 115, 223/116, 111, 120

(56) References Cited

U.S. PATENT DOCUMENTS

| | | | | |
|---|---|---|---|---|
| 143,408 | | 10/1873 | Dorsett . | |
| 149,465 | | 4/1874 | Geer . | |
| 212,128 | * | 2/1879 | Burdick | 223/115 |
| 434,653 | * | 8/1890 | Bommer | 223/115 |
| 1,210,295 | | 12/1916 | Fogelstrom et al. . | |
| 1,274,500 | * | 8/1918 | Bell | 223/115 |
| 1,293,318 | | 2/1919 | Boissiere et al. . | |
| 1,893,280 | | 1/1933 | Gerfen . | |
| 2,571,447 | * | 10/1951 | Hilton | 223/115 |
| 3,652,009 | | 3/1972 | Foster . | |
| 4,226,346 | | 10/1980 | Turner . | |

* cited by examiner

*Primary Examiner*—Bibhu Mohanty
(74) *Attorney, Agent, or Firm*—Schmeiser, Olsen & Watts

(57) ABSTRACT

A bootjack having first and second elongate arms hingedly connected along their long dimension is disclosed, the bootjack being rotatable about an axis defined by the hinge between open and closed positions. In its closed position the bootjack has a long and slender shape that is well suited for storage in a boot. In an open position, the arms define an oblong channel therebetween to receive and grip the heel of a boot, thereby assisting the wearer with removal of the boot. The arms contain cutouts in which supports are securely attached. The supports are positioned so as to hold the bootjack at an angle with the horizontal when the bootjack is in its open position on a generally horizontal surface, and to slide past each other when the bootjack is rotated to a closed position.

15 Claims, 4 Drawing Sheets

FOLDABLE BOOTJACK

BACKGROUND OF THE INVENTION

1. Technical Field

This invention generally relates to a bootjack, and more specifically relates to a bootjack having a hinge on its long axis about which the bootjack is rotatable between an open and a closed position.

2. Background Art

A bootjack is a tool used to assist a boot wearer in removing the boot from his or her foot. Because boots extend well past a person's ankles, generally rising to the middle of the calf or beyond, and because boots that are properly fitted tightly engage the wearer's foot and leg, they are often very difficult to remove without assistance. Bootjacks allow a person, acting alone, to easily remove even snug, well-fitting boots by providing a device to retain the boot in a fixed position while the foot is lifted and withdrawn.

Bootjacks of one kind or another have existed for some time. Among the existing variations are bootjacks with adjustable arms for gripping boots with different heel widths, bootjacks with hand rails that are large enough to stand on comfortably, and bootjacks with foot bars or heel gripping arms that fold underneath the boojack's body. Existing bootjacks, however, even if foldable, can be bulky and difficult to store, especially in the limited space available while traveling. A further problem with many existing bootjacks is their complicated adjustment or locking mechanisms, which can wear out, break, or malfunction. Therefore, there exists a need to provide a boojack of simple, sturdy construction that is capable of being folded into a slender, easily transportable form when not in use.

DISCLOSURE OF INVENTION

According to the present invention, a bootjack has left and right elongate arms hingedly connected along their long dimension and rotatable about the axis defined by the hinge between open and closed positions. In its closed position the bootjack has a long and slender shape that is well suited for storage in a boot. The arms define an oblong channel therebetween to receive and grip the heel of a boot, thereby assisting the wearer with its removal. The arms contain cutouts in which feet are securely attached. The feet are positioned so as to hold the bootjack at an angle with the horizontal when the bootjack is in its open position on a generally horizontal surface, and to slide past each other when the boojack is rotated to a closed position.

The bootjack of the present invention is easy to store and easy to travel with, in part because of the way it folds. The hinge location along the long dimension of the bootjack allows the device when folded to be slender enough to fit into a boot, thus taking up no extra room in limited spaces such as suitcases, vehicles, or hotel rooms. Furthermore, because the hinge is the only moving part of the bootjack, there are fewer pieces to wear out or malfunction, and less chance the bootjack will have to be replaced or repaired. The feet, for example, are arranged in such a way as to allow them to be permanently fixed in a single position on the bootjack yet still conform to the compact configuration enjoyed by the rest of the device when in a closed position. The bootjack's simple design permits it to be easily and quickly constructed with simple tools.

The foregoing and other features of the invention will be apparent from the following more particular description of certain embodiments of the invention, as illustrated in the accompanying drawings.

BRIEF DESCRIPTION OF DRAWINGS

The various embodiments of the present invention will hereinafter be described in conjunction with the appended drawings, where like designations denote like elements.

MODES FOR CARRYING OUT THE INVENTION

As will be made clear in the following detailed description, a foldable bootjack has left and right elongate arms hingedly connected along their long dimension and rotatable about the axis defined by the hinge between open and closed positions. In its closed position the bootjack has a long and slender shape that is well suited for storage in a boot. The arms define an oblong channel therebetween to receive and grip the heel of a boot, thereby assisting the wearer with its removal. The arms contain cutouts in which feet are securely attached. The feet are positioned so as to hold the bootjack at an angle with the horizontal when the bootjack is in its open position on a generally horizontal surface, and to slide past each other when the bootjack is rotated to a closed position.

Figure 1:
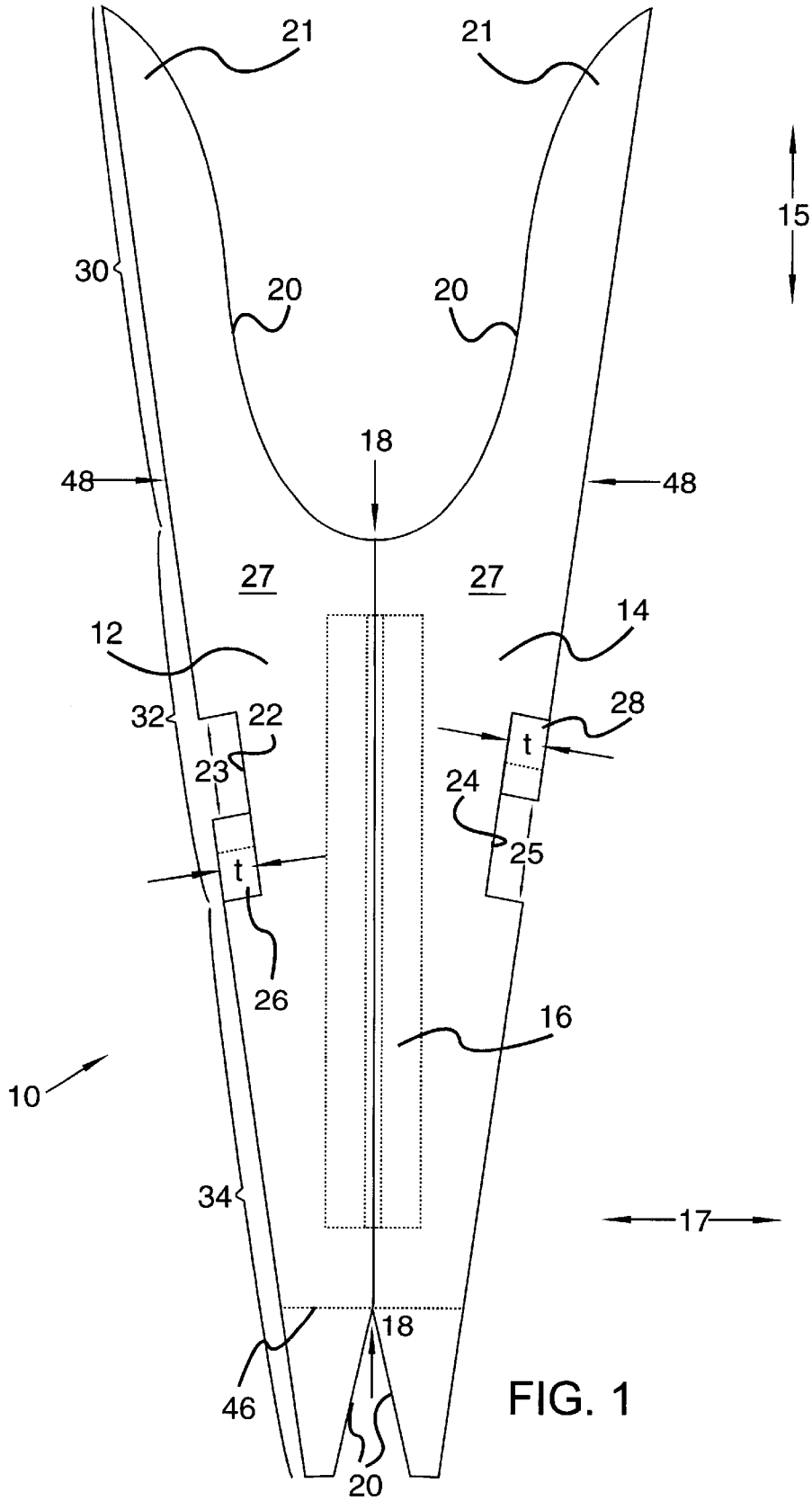
FIG. 1 is a top view of the present invention in an open position.

Referring now to the figures, and in particular to FIG. 1, a bootjack 10 has a left elongate arm 12 and a right elongate arm 14. It should be noted that all direction-based references and all references to orientation, except where stated otherwise, are to be interpreted as though bootjack 10 were in its open position and oriented as shown in FIG. 1. Elongate arms 12 and 14 are longer than they are wide, thus defining a long dimension in the direction of line 15 and a short dimension in the direction of line 17. In one embodiment, for example, elongate arms 12 and 14 may be approximately thirteen inches long and roughly an inch and a half wide at their widest point.

Figure 2:
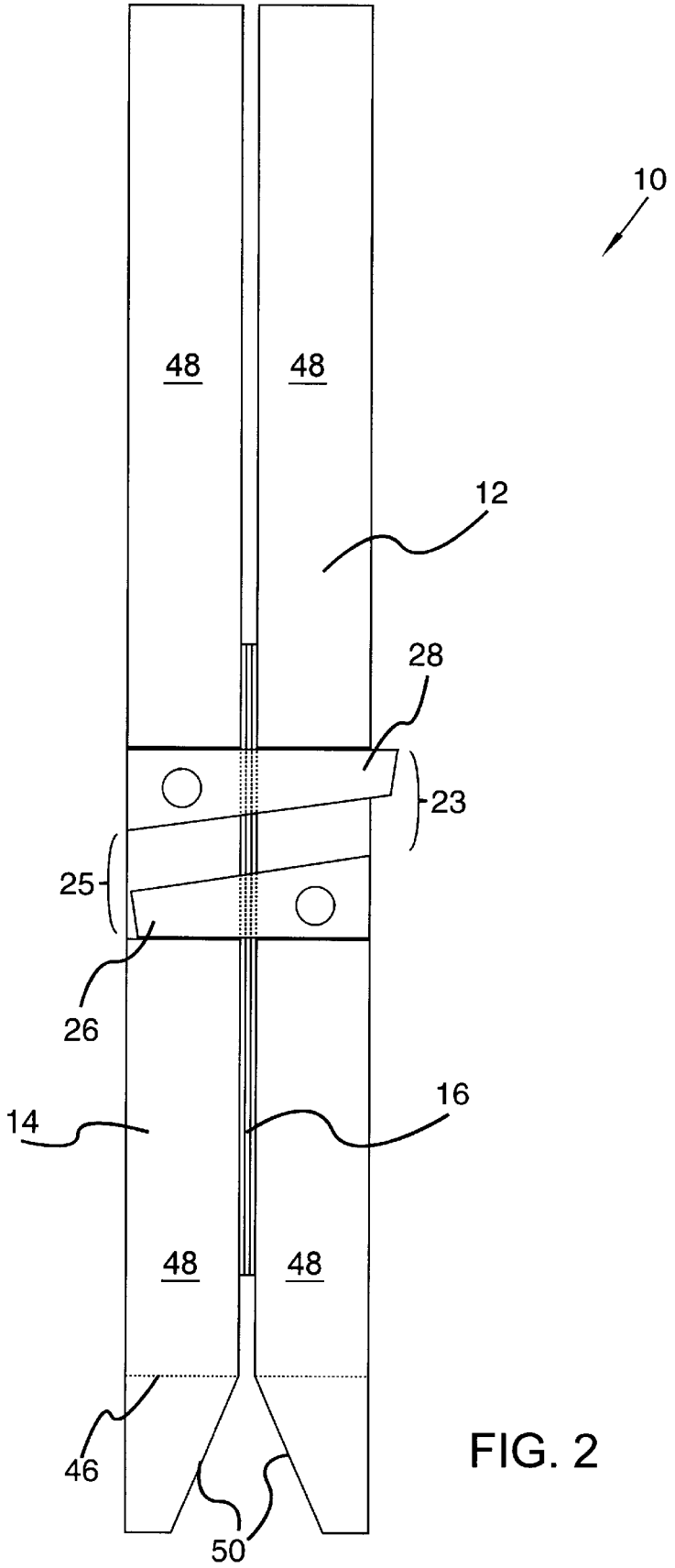
FIG. 2 is a bottom view of the present invention in a closed position.
Figure 4:
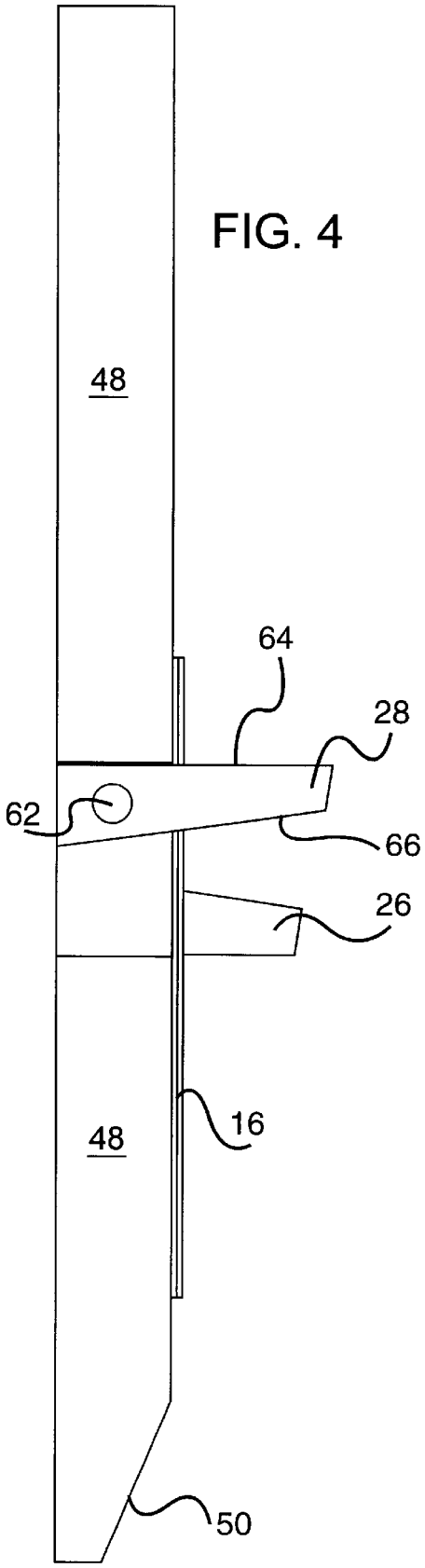
FIGS. 4 and 5 are side views of the open bootjack, from, respectively, the right and the left.
Figure 5:
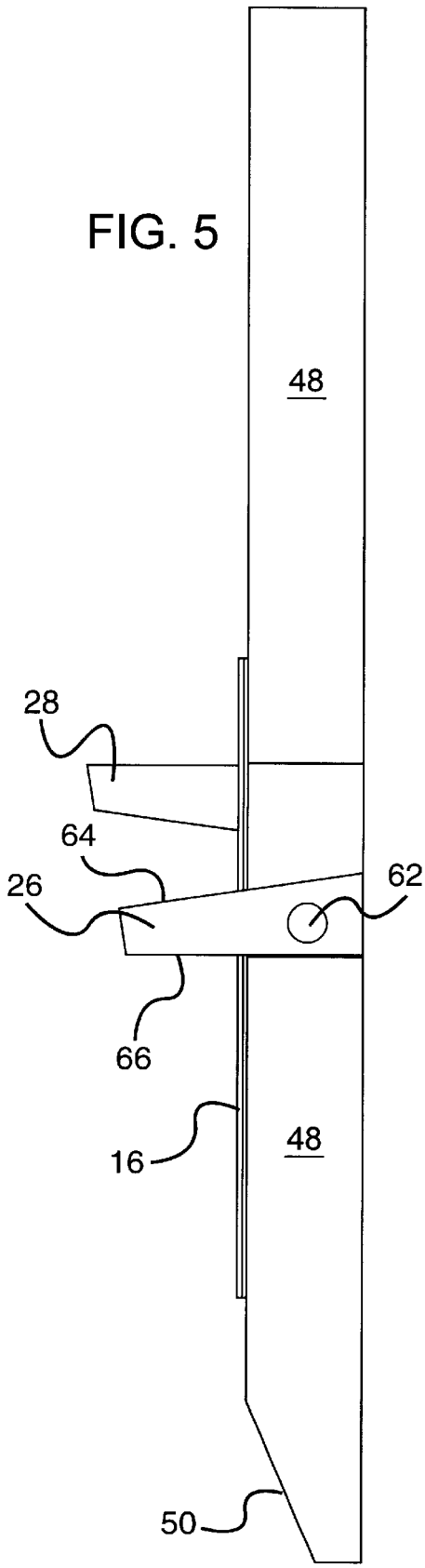

Elongate arms 12 and 14 have an inside surface 20, a top surface 27, an outside surface 48, best seen in FIG. 2, and a bottom surface 50, best seen in FIGS. 4 and 5. Only top surface 27 is visible in FIG. 1. A hinge 16, shown in dashed lines in FIG. 1, is attached to bootjack 10 on bottom surface 50, and lies parallel to long dimension 15, meaning that its long dimension has the same orientation as the long dimension of bootjack 10. In one embodiment, hinge 16 is attached by wood screws extending through hinge 16 and substantially perpendicularly into bottom surface 50 of arms 12 and 14. The dividing line between left elongate arm 12 and right elongate arm 14 defines an axis of rotation 18 about which arms 12 and 14 are rotatable between the open position shown in FIG. 1 and the closed position of FIG. 2.

Elongate arms 12 and 14 terminate at their upper ends in horns 21. The portion of bootjack 10 including horns 21 comprises an upper region 30 of bootjack 10. The inside surface 20 of arms 12 and 14 in upper region 30 defines the perimeter of an oblong channel, formed between horns 21, that receives and grips the heel of a boot.

Left elongate arm 12 has a left cutout 22 for receiving a left foot or support 26. Similarly, right elongate arm 14 has a right cutout 24 which receives a right foot or support 28. Cutouts 22 and 24 are formed by cutting into outside surface 48 of elongate arms 12 and 14. Cutouts 22 and 24 may be larger than necessary to receive feet 26 and 28, leaving an upper gap 23 and a lower gap 25 in left cutout 22 and right cutout 24, respectively. The function of these gaps 23 and 25 will be explained below. Left foot 26 is secured to left elongate arm 12 at the bottom of left cutout 22, while right foot 28 is attached to right elongate arm 14 at the top of right cutout 24, as further described in connection with FIGS. 4 and 5. The area of bootjack 10 beginning where horns 21 join at axis 18 and ending at the bottom of left cutout 22 and right cutout 24 comprises middle region 32 of bootjack 10.

Figure 3:
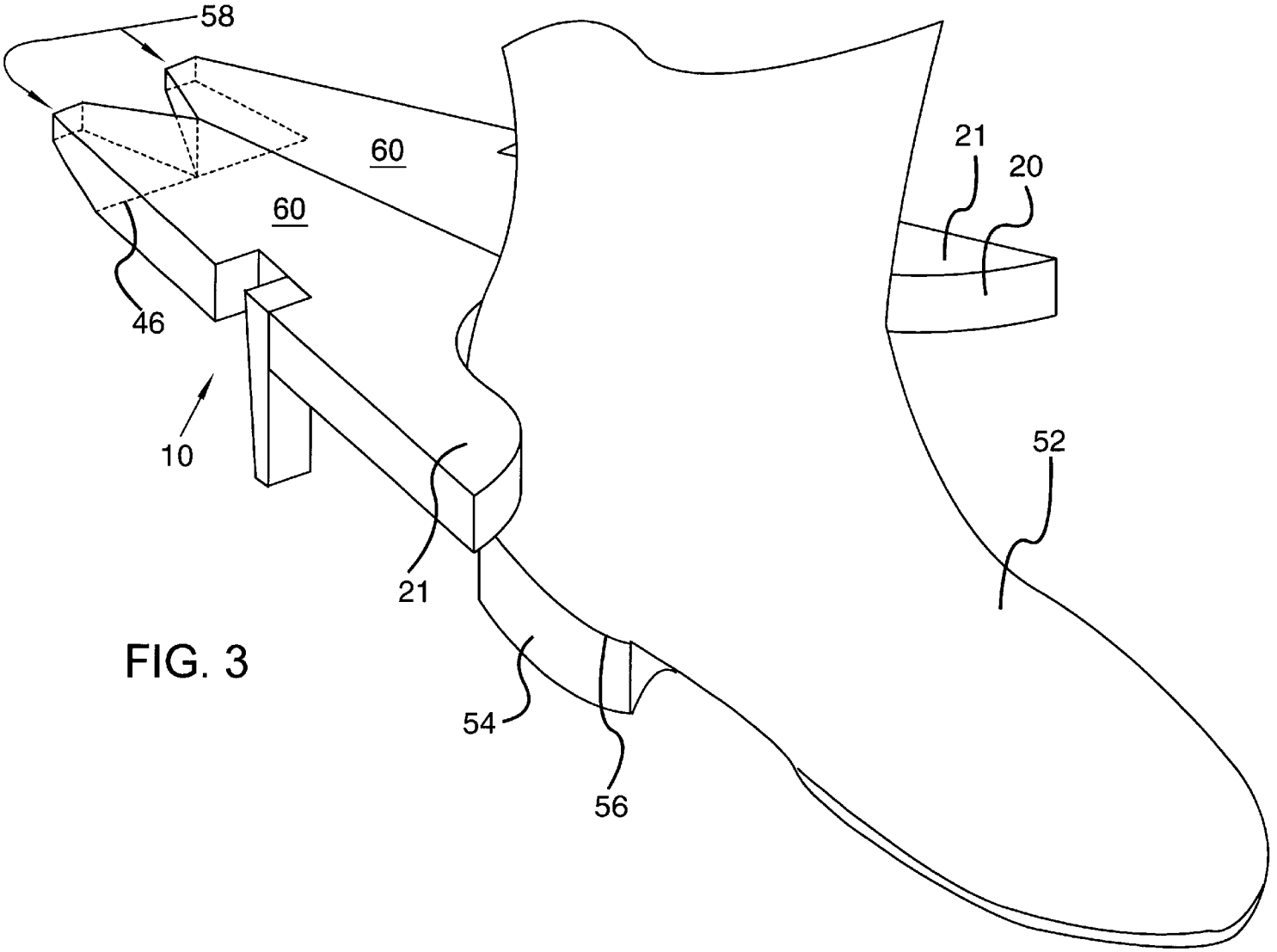
FIG. 3 is a perspective view thereof showing a manner of operation.

The portion of bootjack 10 below middle region 32 comprises lower region 34, which includes a dividing line 46. Beginning at dividing line 46 and continuing to the lower end of bootjack 10, inside surface 20 of elongate arms 12 and 14 tapers away from axis 18, forming a V-shaped notch therebetween. The general structure of left elongate arm 12 may thus be described in the following manner. Inside surface 20 follows a smooth curve in upper region 30, is straight and flat in middle region 32 and much of lower region 34, and tapers away from axis 18 below dividing line 46. The top surface 27 of left elongate arm 12 is the surface visible in FIG. 1. It is flat and smooth, interrupted only by left cutout 22. The outside surface 48 of left elongate arm 12 is not visible in this picture but can be seen in FIGS. 2 and 5. With the straight, flat portion of inside surface that comprises middle region 32 and much of lower region 34 acting as a line of reference, outside surface 48 angles inwardly toward axis 18, interrupted, like top surface 27, only by left cutout 22. Outside surface 48 is a straight line displaced from the flat portion of inside surface 20 referred to above through a small angle. The bottom surface 50 of left elongate arm 12, not visible in the figure but apparent in FIG. 2, is nearly identical to top surface 27. The major difference is that below dividing line 46, the bottom surface slopes towards top surface 27 of elongate arm 12. The combined effect of this slope in bottom surface 50 and the similar slope or taper of inside surface 20 creates at the lower extremity of lower region 34 a relatively small, squarish base 58 that is best shown in FIG. 3. The foregoing description of the general structure of left elongate arm 12 applies also to right elongate arm 14, with the understanding that some minor changes in the description of locations and orientations must be made in order to account for the position of right elongate arm 14 on the opposite side of bootjack 10.

Referring now to FIG. 2, bootjack 10 is shown in a closed position, elongate arms 12 and 14 having been rotated towards each other by means of hinge 16. Note that this is a bottom view of bootjack 10. Consequently, left elongate arm 12 appears on the right in this view, while right elongate arm 14 is shown on the left side of the figure. In this regard, recall that all directional references, except where noted, such as to right and left sides, are to be interpreted as if bootjack 10 were in its open position and oriented as shown in FIG. 1.

With bootjack 10 in a closed position, left foot 26 and right foot 28 lie flush with outside surface 48 of elongate arms 12 and 14 by virtue of their location within cutouts 22 and 24. Right foot 28 rests in upper gap 23 while left foot 26 rests in lower gap 25. The thickness t of feet 26 and 28 is approximately equal to the depth of cutouts 22 and 24, allowing feet 26 and 28 to lie flush with outside surface 48 as stated above. When bootjack 10 is in its closed position, right foot 28 protrudes slightly from left cutout 22 in the manner shown. Left foot 26, being shorter than right foot 28, fits entirely within right cutout 24. The purpose for this will be more clearly discussed below. The slope of bottom surface 50 towards the top surface of arms 12 and 14 can be clearly seen in this FIG. 2.

As illustrated in FIG. 2, bootjack 10 has a compact shape when in a closed position. The long and slender profile of bootjack 10 when closed is ideal for storage in a boot, or other storage area, where bootjack 10 would require no extra room in a limited space such as a suitcase, a vehicle, or a hotel room.

The manner in which bootjack 10 is employed to remove a boot is shown in FIG. 3. Bootjack 10 is first placed, in an open position, on a floor or other firm, horizontal surface. Feet 26 and 28 lift a substantial portion of bootjack 10 off the floor. The points of contact of bootjack 10 with the horizontal surface are feet 26 and 28 and bottom surface 50 at dividing line 46.

A boot 52 is positioned in the oblong channel wherein horns 21 surround the heel 54 of boot 52. The oblong channel is shaped so as to conform to the shape of the back wall of boot 52. Boot 52 is connected to boot heel 54 at a lip 56. Lip 56 is placed in contact with bottom surface 50 of bootjack 10 between horns 21. Downward pressure, i.e., pressure directed generally towards the horizontal surface on which bootjack 10 is resting, is then applied to area 60 on top surface 27 of elongate arms 12 and 14 in lower region 34. This downward pressure, which may for example be supplied by stepping on bootjack 10 with the foot not in the boot to be removed, acts in opposition to the upward pressure created as a foot is lifted out of boot 52. Said another way, the friction between the sides of boot 52 and a foot on which boot 52 is worn is overcome by the opposing force applied to boot 52 at lip 56 by bottom surface 50 of bootjack 10, and a foot may be easily slipped out of boot 52 without relying on a second person for assistance.

FIGS. 4 and 5 show the bootjack 10 in an open position from, respectively, the right and left sides. The visible surfaces of elongate arms 12 and 14 are outside surfaces 48. Left foot 26 and right foot 28 are attached, respectively, to left elongate arm 12 and right elongate arm 14 with fasteners 62, which may in one embodiment of the invention be metal screws. Fasteners 62 are inserted through feet 26 and 28 into outer surface 48 at cutouts 22 and 24 in a direction substantially perpendicular to outer surface 48. Metal screws are characterized by a wider spacing between threads than is normal in other types of screws and are thus able to hold materials together very effectively. Nails or an adhesive such as glue are among the alternative fastening means that could also be used. In one embodiment of bootjack 10, fasteners 62 extend almost all the way through elongate arms 12 and 14, terminating approximately one eighth of an inch before reaching inner surfaces 20. This helps prevent splitting of elongate arms 12 and 14 even when great force is applied to them, as when boot 52 is jammed violently between horns 21 of bootjack 10.

As can be seen in both FIG. 4 and FIG. 5, right foot 28 is longer than left foot 26. This is required because right foot 28 is attached at the top of right cutout 24, placing it further above the horizontal surface on which bootjack 10 rests than is left foot 26, which is attached at the bottom of left cutout 22. Because right foot 28 is further above the horizontal surface, it must be longer than left foot 26 in order to reach the horizontal surface. The bottoms of feet 26 and 28 are angled in order to sit flat on the horizontal surface they contact. In other words, the leading edge 64, both of left foot 26 and right foot 28, is longer than the trailing edge 66.

While the invention has been particularly shown and described with reference to certain embodiments thereof, it will be understood by those skilled in the art that various changes in form and details may be made therein without departing from the spirit and scope of the invention as set forth herein.

I claim:

1. A bootjack comprising a first elongate arm and a second elongate arm hingedly connected along a first axis, forming a channel therebetween to receive and grip a heel of a boot, said first elongate arm having a cutout for receiving a support and said second elongate arm having a cutout for receiving a support, said supports holding said bootjack at an angle with a horizontal plane when said bootjack is placed in an open position on a surface, one of said supports being longer than the other of said supports, said bootjack capable of being rotated about said first axis.

2. The bootjack of claim 1 wherein said support is attached to said first elongate arm at a lower region of said first cutout.

3. The bootjack of claim 1 wherein said support is attached to said second elongate arm at an upper region of said second cutout.

4. The bootjack of claim 1 wherein said channel is formed in an upper region of said bootjack and said cutouts are formed in a middle region of said bootjack, the remainder of said elongate arms forming a lower region of said bootjack.

5. The bootjack of claim 4 wherein said lower region has a width and a length capable of supporting the application of pressure acting in opposition to pressure applied to said bootjack by the boot while it is being removed.

6. The bootjack of claim 4 wherein said elongate arms rotate about said first axis between an open and a closed position, said axis being parallel to the long dimension of said elongate arms.

7. A bootjack comprising a first elongate arm and a second elongate arm connected by a hinge, said hinge forming an axis parallel to a long dimension of said bootjack about which said bootjack is rotatable between an open and a closed position, said elongate arms forming an oblong channel therebetween to receive and grip a heel of a boot, said oblong channel being formed in an upper region of said bootjack, said first elongate arm having a cutout for receiving a support in a lower portion of said cutout, said second elongate arm having a cutout for receiving a support in an upper portion of said cutout, the support of said first arm being longer than said support of said second arm, said supports being formed in a middle region of said bootjack, wherein said supports hold said bootjack at an angle when said bootjack is placed in an open position on a generally horizontal surface.

8. The bootjack of claim 7 wherein each of said supports are attached to said elongate arms by a fastening device, said fastening device entering said elongate arms substantially perpendicularly to the long axis of said elongate arms, said fastening device extending substantially all the way through said elongate arms.

9. The bootjack of claim 8 wherein said fastening device is a metal screw.

10. The bootjack of claim 7 wherein said elongate arms have a first width near said upper region of said bootjack and a second width at the tip of said lower region.

11. The bootjack of claim 10 wherein said first width is greater than said second width.

12. The bootjack of claim 10 wherein said arms in said lower region comprise a plurality of surfaces, a first surface being straight, a second surface having a first slope with respect to said first surface, a third surface having a second slope with respect to said first surface, said third surface being shorter than said second surface, said third surface being adjacent said tip of said lower region, and a fourth surface having a third slope in a different plane than said first and second slopes, said fourth surface being adjacent said tip of said lower region.

13. The bootjack of claim 12 wherein said second slope is greater than said first slope.

14. The bootjack of claim 12 wherein said third and fourth surfaces are approximately equal in length.

15. The bootjack of claim 7 wherein said support of said first elongate arm contacts said cutout of said second elongate arm and said support of said second elongate arm contacts said cutout of said first elongate arm when said bootjack is in said closed position.

* * * * *